US006217078B1

(12) United States Patent
Roth et al.

(10) Patent No.: US 6,217,078 B1
(45) Date of Patent: Apr. 17, 2001

(54) LABEL SHEET

(75) Inventors: Joseph D. Roth, Springboro, OH (US); Wayne D. Finster, Viroqua, WI (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/114,434

(22) Filed: Jul. 13, 1998

(51) Int. Cl.[7] ..... B65D 27/06; B42D 15/00

(52) U.S. Cl. ..... 283/81; 283/61; 283/62; 283/98; 283/101; 283/105

(58) Field of Search ..... 283/61, 62, 81, 283/98, 101, 105

(56) References Cited

U.S. PATENT DOCUMENTS

| | | | | |
|---|---|---|---|---|
| 4,410,203 | | 10/1983 | Lothrop . | |
| 4,771,891 | | 9/1988 | Sorensen et al. . | |
| 4,778,153 | | 10/1988 | Bachmane et al. . | |
| 5,219,183 | * | 6/1993 | McKillip | 283/62 |
| 5,328,208 | | 7/1994 | Garrison . | |
| 5,350,612 | | 9/1994 | Stern et al. . | |
| 5,501,393 | | 3/1996 | Walz . | |
| 5,580,640 | | 12/1996 | Kraft et al. . | |
| 5,601,313 | * | 2/1997 | Konkol et al. | 283/81 |
| 5,700,536 | | 12/1997 | Steidinger . | |
| 5,704,650 | | 1/1998 | Laurash et al. . | |
| 5,853,836 | | 12/1998 | Zoss . | |
| 5,884,944 | * | 3/1999 | Durham | 283/81 |

FOREIGN PATENT DOCUMENTS 2050035 3/1971 (FR) .

OTHER PUBLICATIONS

Wallace News & Highlights—New Product Announcements, http://www.wallace.com/news/newproducts.asp, May 13, 1999, pp 1–2.

Rhodia, Inc., "UV–Silicone Cure System", Mar. 9, 1998, 7 pages.

Co–pending application Ser. No. 09/151,000, filed Sep. 10, 1998, by inventor Joseph D. Roth et al., entitled "Selective Release Label Sheet", assigned to NCR Corporation.

* cited by examiner

*Primary Examiner*—A. L. Wellington
*Assistant Examiner*—Mark T. Henderson
(74) *Attorney, Agent, or Firm*—Francis L. Conte

(57) ABSTRACT

A label sheet includes an overlay attached to a liner by an adhesive. The liner includes adjoining relatively low and high adhesion surfaces. And, the adhesive bonds together the overlay and liner at the high adhesion surface and allows separation of the overlay at the low adhesion surface.

15 Claims, 5 Drawing Sheets

LABEL SHEET

BACKGROUND OF THE INVENTION

The present invention relates generally to laminated label sheets, and, more specifically, to the manufacture thereof.

Label sheets are commonly available in various configurations with and without printing thereon. A typical label sheet is a laminate of a paper overlay and an underlying release liner. An adhesive bonds the overlay to the liner in the finished article.

In typical use, information is printed atop the overlay, and the overlay is then removed from the liner by being peeled therefrom. The peeled away label has exposed adhesive so that it may be pressed against paper or other object for attachment thereto. A typical release liner is coated over one side with liquid silicone which is thermally cured for providing a low adhesion surface thereatop to which the overlay is temporarily bonded. The adhesive provides a weak bond between the overlay and the silicone liner which sufficiently maintains together the laminate until it is desired to remove the overlay from the liner.

More complex label sheets include several labels or decals in the overlay defined by respective perimeter die-cuts therebetween which allow removal of individual labels from the liner. The individual labels may be directly adjacent to each other or there may be an intervening label rim or border which remains attached to the liner after the individual labels are peeled away.

A further increase in complexity of the label sheet includes an integral paper form attached to the label portion of the overlay which does not overlie the liner. This type of label sheet may be manufactured using a lap joining method wherein the label and liner laminate is premanufactured and lap joined along an edge thereof to the paper form. In another, integrated, method of manufacture, the entire overlay, including the label and form portions thereof, is separately manufactured in a common sheet and the liner is then bonded below the label portion thereof.

These various label sheets nevertheless use a commonly fabricated release liner which is typically manufactured in large rolls with the silicone in liquid form being applied over the entire surface of the liner paper which is then thermally cured. The large roll of release liner is then cut into individual smaller rolls for use in various label sheet applications as required.

Since the low adhesion silicone covers the entire front surface of the release liner, only weak adhesive bonds with the paper overlay may be formed therewith. This presents a problem when several individual labels are formed in the overlay. For example, when the label sheet is passed through a laser printer, individual labels may separate from the liner as the adhesive is softened under heat and the sheet is bent tightly around narrow rollers. Not only may the label sheet be damaged during laser printing, but the released portions thereof have exposed adhesive which may adhere the overlay to internal components of the printer causing jamming thereof. Additional adhesive may also be squeezed out from between the labels and liner due to the heat and squeezing in the printer, and may also lead to printer jamming.

Furthermore, when an individual label is removed from an adjoining label border, the border portion itself may also separate from the liner, and the exposed adhesive on the border may inadvertently attach the border to other papers which is undesirable.

Another problem attributable to this liner construction occurs when the overlay includes a perforation line. Such lines are provided to tear apart portions of the label for various reasons. Since the label necessarily has a weak bond with the liner, tearing the label along the perforations typically breaks this bond and allows the label to slide on the liner and typically experience side tears emanating from the perforation line.

Since the liner is typically manufactured in large rolls, cut to size, and used for various applications, it is not practical or even possible to provide printing atop the liner and below the silicone surface. This leaves only the front and back sides of the overlay and the back side of the liner as available surfaces for printing, and therefore decreases the potential efficiency of the label sheet.

Accordingly, it is desired to provide an improved label sheet which resolves one or more of these various limitations in conventionally manufactured label sheets.

BRIEF SUMMARY OF THE INVENTION

A label sheet includes an overlay attached to a liner by an adhesive. The liner includes adjoining relatively low and high adhesion surfaces. And, the adhesive bonds together the overlay and liner at the high adhesion surface and allows separation of the overlay at the low adhesion surface.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
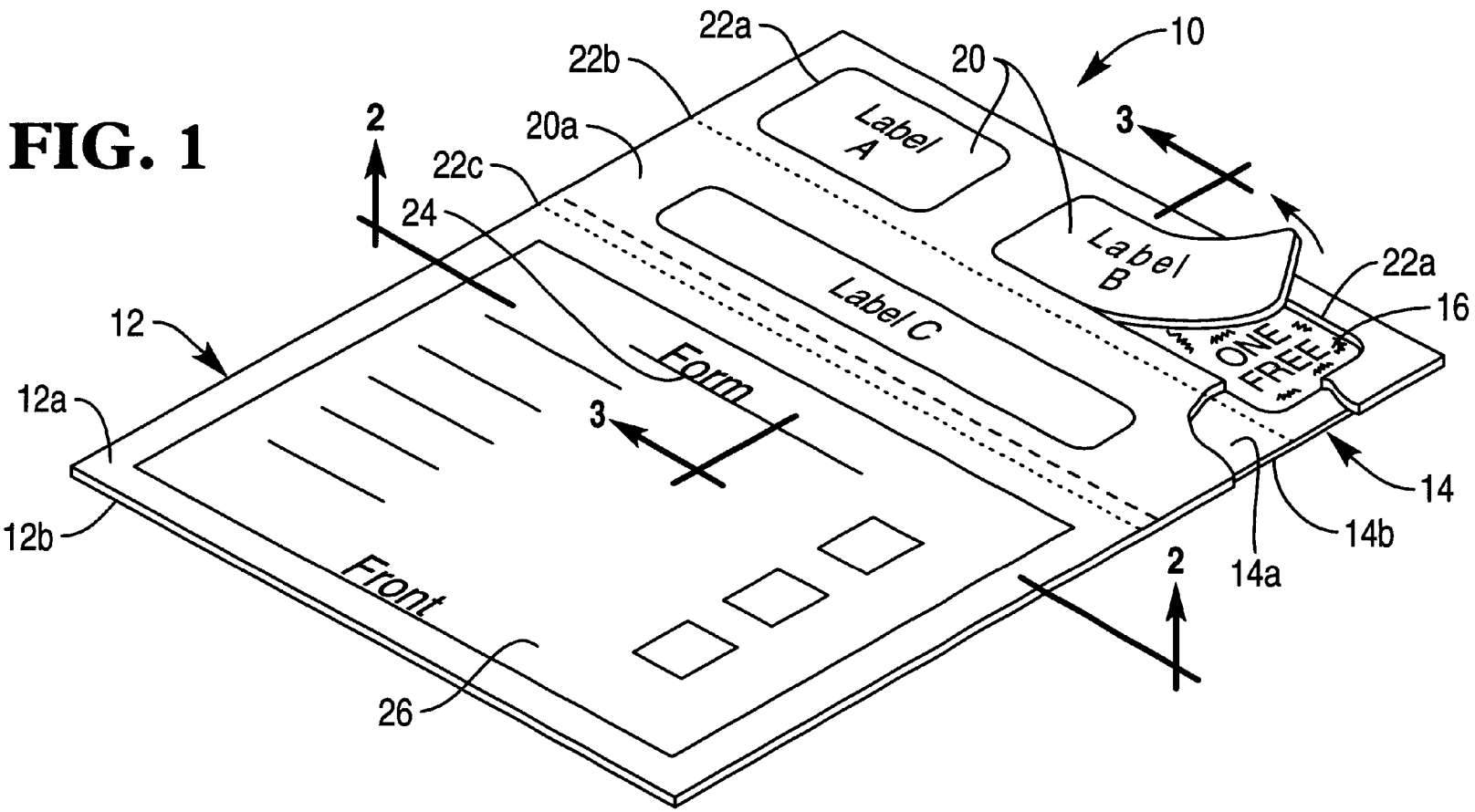
FIG. 1 is an isometric view of the front side of a label sheet in accordance with an exemplary embodiment of the present invention.
Figure 2:
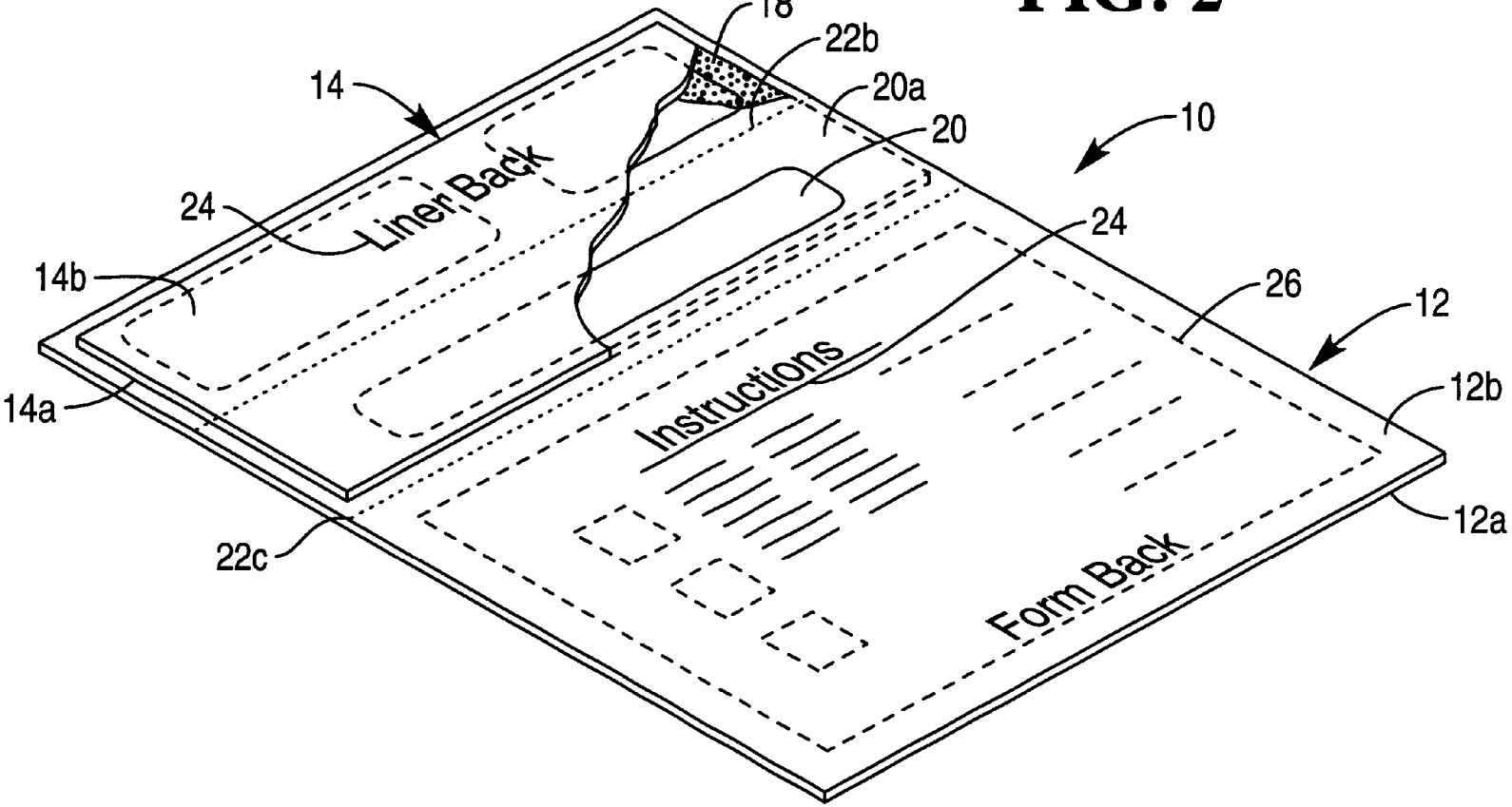
FIG. 2 is an isometric view of the back side of the label sheet illustrated in FIG. 1 and taken along line 2—2.

Illustrated in FIGS. 1 and 2 is a label sheet or laminate 10 in accordance with an exemplary embodiment of the present invention. The sheet 10 includes a face sheet or overlay 12 which is preferably a single rectangular paper sheet although it may have other composition and configuration as desired. The overlay 12 includes a front or outer side 12*a* and an opposite inner or back side 12*b*.

The overlay is laminated to an underlying release liner 14 which includes an inner or front side 14*a* which faces the overlay back 12*b*, and an opposite outer or back side 14*b*. The overlay 12 is illustrated in sectional view in FIG. 3 laminated to the liner 14, with the liner 14 being shown in isolation in FIG. 4.

Figure 4:
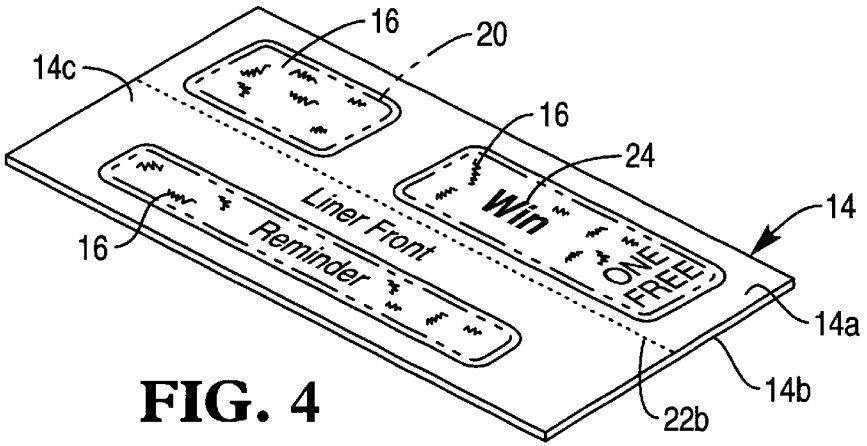
FIG. 4 is an isometric view of the front side of the liner illustrated in FIG. 3 and taken along line 4—4.

In accordance with the present invention, the liner 14 illustrated in the exemplary embodiment in FIG. 4 includes both a relatively low adhesion surface 16 formed, for example, by applying silicone to a selected portion of the liner front 14*a*, and a relatively high adhesion surface 14*c* which may simply be the remaining, exposed rim or border portion of the liner front 14*a* after application of the silicone. The liner 14 may be made of any suitable material such as paper, for example, which be locally coated with the silicone as described hereinbelow in a preferred manufacturing method.

Figure 3:
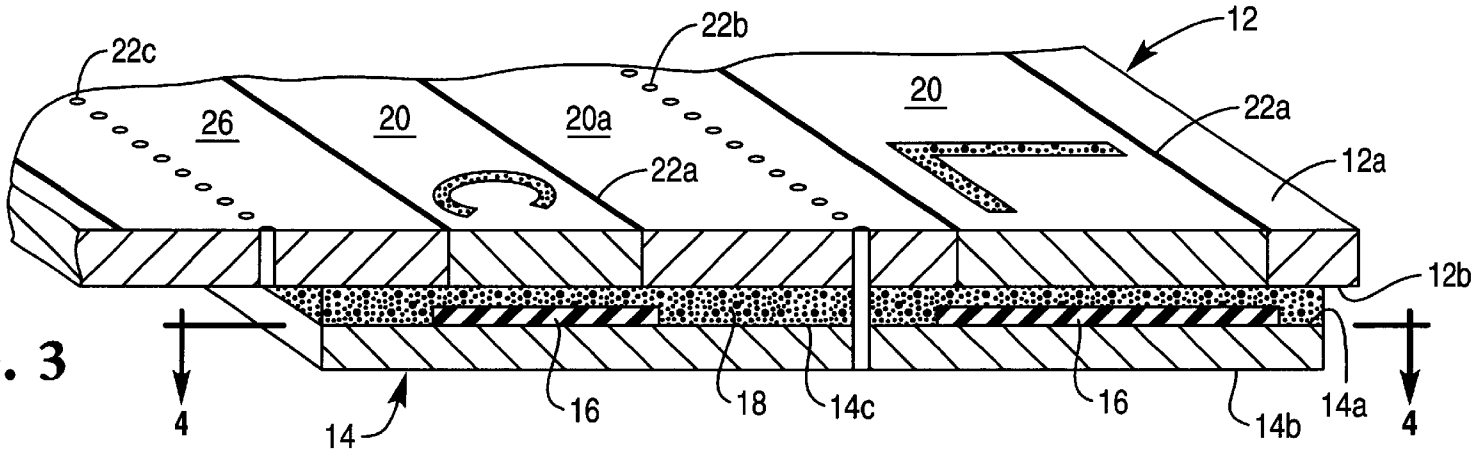
FIG. 3 is a sectional view through a portion of the label sheet illustrated in FIG. 1 and taken along line 3—3.

As shown in FIG. 3, an adhesive 18 is used to permanently bond together the overlay and liner at the high adhesion surface 14*c* and allows peeling separation of the overlay at the low adhesion surface 16. The adhesive 18 is permanently bonded to the overlay back 12*b* and covers the entire liner front 14*a*, and may have any conventional composition to form a weak bond over the low adhesion surface 16 and a substantially permanent bond over the high adhesion surface 14*c*. In this way, the overlay is intimately bonded to the liner over the liner's entire front surface except at the selected low adhesion surfaces 16. This prevents the unintended separation of the overlay from the liner except at the local regions of the low adhesion surfaces 16.

As shown in FIG. 1, the overlay 12 may include one or more decals or labels 20 having any suitable configuration or shape. The overlay may include one large label laminated over the entire liner 14, or a plurality of individual labels either directly adjoining each other or separated by a remaining label border or rim 20*a* as shown for example. In the FIG. 1 embodiment, three differently sized labels are framed in the common border 20*a* laminated atop the liner 14 for showing various possible alternative features of the present invention. The individual labels or decals 20 may be blank, or printed with numerals, letters, or graphics.

Referring again to FIG. 4, the low adhesion surface defines a patch or spot, also designated 16, which generally matches the corresponding configurations of the individual labels such as the rectangles illustrated. And, the high adhesion surface 14*c* surrounds the several spots 16 along the entire perimeters thereof. In this configuration, the liner 14 includes a plurality of the spots 16 which correspond with the respective labels 20 for allowing individual removal or peeling of the labels from both the rim 20*a* and the liner 14. In this way, the individual labels may be easily removed in view of the weak bond between the underlying adhesive thereof and the liner spot 16 therebelow. The label border 20*a* is strongly or permanently bonded to the high adhesion surface defining the liner border 14*c*.

As shown initially in FIG. 1, the overlay 12 further includes one or more cleaved separation joints, designated by the prefix 22, which may be conveniently used for separating the overlay therealong. A first form of the separation joint is a conventional die-cut 22*a* which surrounds the individual labels 20 along the perimeters thereof in a substantially continuous cut for allowing easy removal of the individual labels from atop the liner 14.

As shown in FIG. 3, the die-cuts 22*a* are preferably disposed atop the respective silicone spots 16 closely adjoining the liner border 14*c*. In this way, individual labels 20 may be peeled away from the liner as illustrated by the partially removed label B in FIG. 1 which separates along the die-cut 22*a*, with the surrounding label border 20*a* remaining securely bonded to the underlying liner 14. This prevents separation of the label border 20*a* and eliminates the problem of exposed adhesive therefrom which could otherwise jam a laser printer for example. Furthermore, the secure bonding of the label border 20*a* to the underlying liner prevents squeeze out of the adhesive when passed through the hot fusion rollers in the laser printer.

As initially shown in FIG. 4, the liner 14 may now also include inked printing 24 in any form such as letters, numerals, and graphics atop the liner front 14*a* and below one or more of the several silicone spots 16. The silicone spots are applied in an extremely thin layer and have a clear or transparent composition for viewing the printing therebelow. As indicated above, it is not possible in the present manufacture of thermally produced silicone release liners to provide printing under the silicone layer. However, in view of the manufacturing process described hereinbelow, printing atop the liner front 14*a* may now be accomplished prior to the application of the silicone spots 16 thereabove.

In the preferred embodiment illustrated in FIG. 1 and 2, the overlay 12 and the liner 14 may now also include printing 24 on both front and back sides thereof, including under the silicone spots 16. The printing becomes visible upon removal of the individual labels and may provide any useful information or promotions thereunder. Since the liner front 14*a* is now available for printing, compression of the entire label sheet 10 may be affected to contain the same amount of information in a reduced size. This reduces both the amount of material required in manufacturing the label sheet 10 as well as reducing its cost.

The printing under the silicone spot 16 is extremely difficult to modify because it is protected by the overlying silicone. This printing is therefore secure from adulteration and may be used for various security purposes not otherwise available in conventional label sheets. Furthermore, the printing below the silicone spots 16 is also protected from chemical and mechanical degradation or attack and substantially increases the longevity of the printing thereunder.

As shown in FIG. 1, a second form of the separation joint includes a plurality of perforations or micro-perforations 22*b* which are disposed linearly across the label border 20*a*, and extend through both the label 20 and the liner 14, and through the adhesive therebetween.

As shown in more detail in FIG. 3, the perforations 22*b* are disposed atop the high adhesion surface of the liner border 14*c* in a path straddling the perforations to define a skip devoid of the silicone. This allows the label and liner to be torn along the perforations 22*b* in a relatively clean tear without separation of the label and liner along the tear. The strong adhesive bond along the perforations 22*b* maintains the integrity of the label/liner joint while permitting the separation along the perforations. This also prevents the inadvertent exposure of adhesive at the torn edges which could inadvertently attach to other papers.

As shown in FIGS. 1 and 2, the overlay 12 may also include a form 26 in the exemplary configuration of a paper sheet extending integrally from the label border 20*a*. And, the liner 14 underlies solely the labels and border and not the form 26. In a preferred embodiment, the entire overlay 12 is a single sheet of paper having portions thereof defining the individual labels 20, the label border 20*a*, and the form 26. The form 26 may have any suitable configuration and may be blank or printed with various information as desired.

Also if desired, the overlay may additionally include a third form of the separation joint having another plurality of perforations 22*c* disposed linearly across the form 26 adjacent the label border 20*a* as illustrated in FIGS. 1 and 2. As shown in FIG. 3, the form perforations 22*c* extend solely through the form 26 since the liner 14 terminates short thereof for allowing the form 26 to be separated from the labels and rim as desired.

The single label sheet 10 disclosed above combines various improvements thereof for clarity of presentation. The most significant feature of the present invention is the spot application of the silicone which allows construction of label sheets not previously possible. These new constructions eliminate previous limitations in conventional label sheets and offer various improvements in the label sheets. The invention may therefore be used in various applications which may benefit from the spot application of the silicone or any other comparable low adhesion surface composition as desired. The invention may be applied to single label sheets, multiple label sheets, and combined label and form sheets. The improved label sheets may be used in various industries including the retail market, and the pharmaceutical market for multifunction pharmacy scripts.

Figure 5:
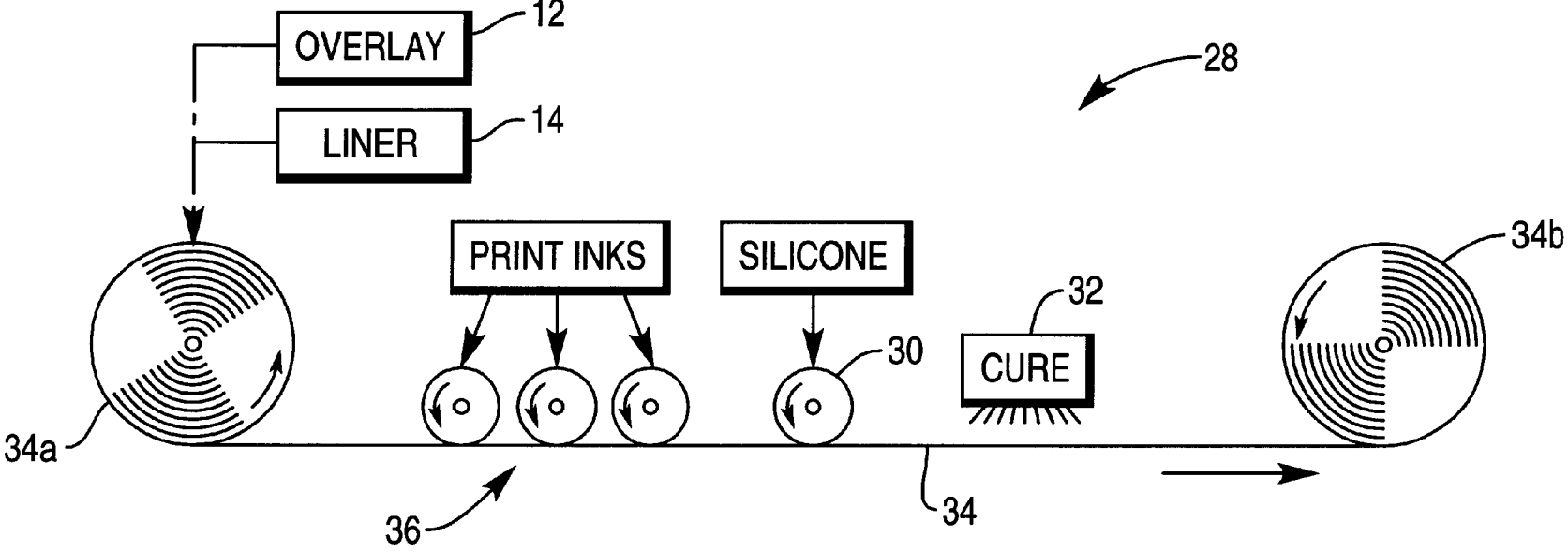
FIG. 5 is a schematic representation of an exemplary printing machine for separately manufacturing an overlay and liner forming the label sheet illustrated in FIG. 1.
Figure 6:
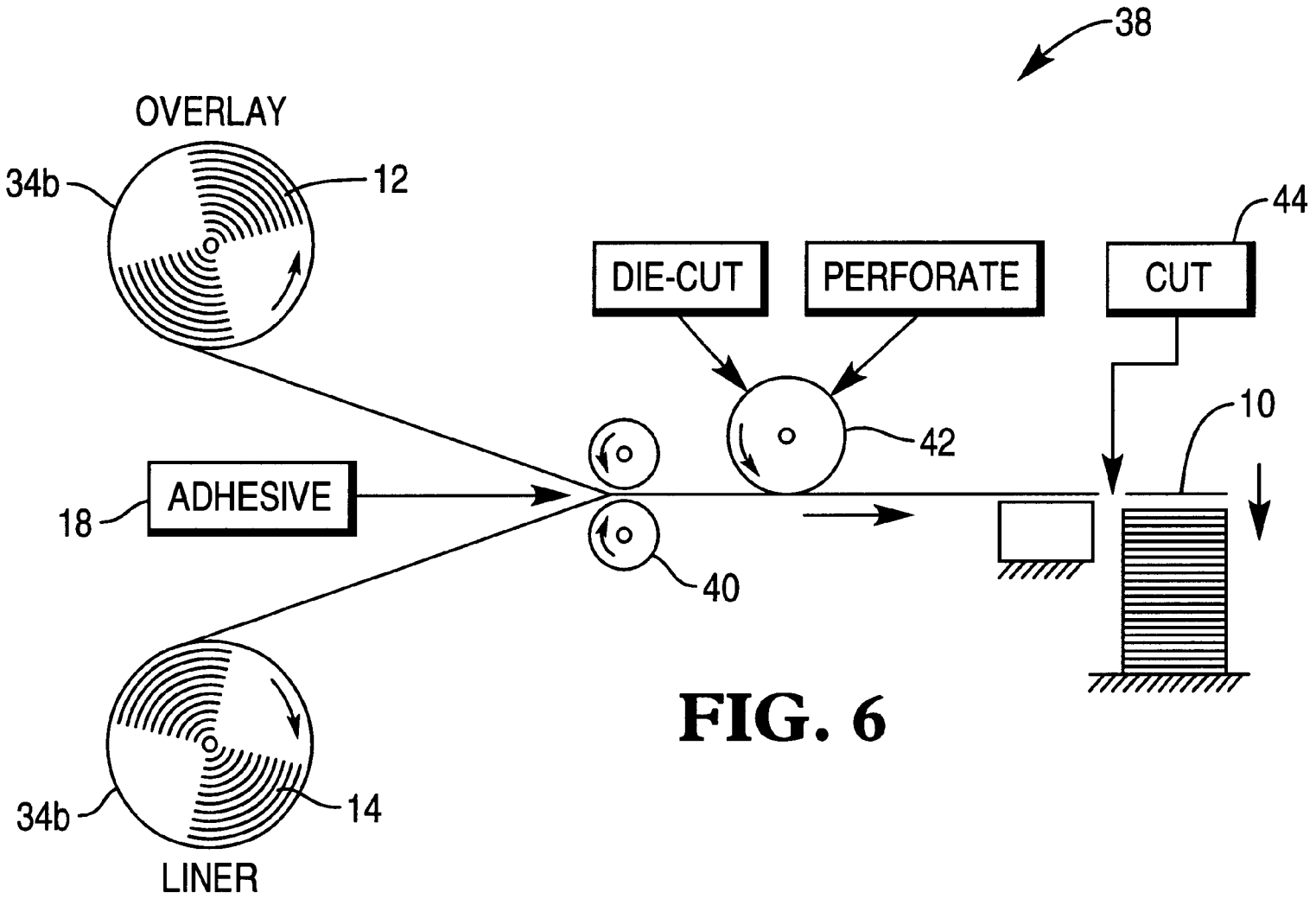
FIG. 6 is a schematic representation of an exemplary laminating machine which bonds together the overlay and liner, adds separation joints therein, and cuts the label sheets to individual size.

FIGS. 5 and 6 illustrate schematically an improved method of making the label sheets 10 in various configurations. Conventional, commercially available equipment is available for individually manufacturing the overlay 12 and the liner 14, and then laminating together these components into the final label sheet.

FIG. 5 illustrates schematically the relevant components of a suitable printing machine 28 such a flexographic printing machine from the Webtron Company, Fort Lauderdale, Fla., under model designation "1618." The machine 28 is conventional except for using a conventional printing drum 30 dedicated for spot application of liquid silicone which may be suitably cured using ultraviolet light (UV) or an electron beam (EB). UV/EB cured liquid silicone resins for use as a printing ink are commercially available from Rhodia Inc., Rock Hill, S.C., under the Silcolease® PC-600, PC-680, PC-670, and PC-702 designations. A suitable curing device 32, such as an ultraviolet light or an electron beam generator is mounted downstream of the silicone printing drum 30 for substantially instantaneously curing the silicone spots 16 as they are applied to a moving continuous web 34 of the liner material unwound from a supply roll 34*a* and rewound upon printing on a takeup roll 34*b*.

The printing machine 28 may be used in a conventional manner by supplying liquid silicone instead of a typical printing ink on the printing drum 30 for the desired pattern for printing the low adhesion surface spots 16 atop only a portion of the liner 14 for leaving a relatively high adhesion surface or liner border thereon. The printing drum 30 is configured for printing one or more of the liner configurations along the width of the web 34 and repeatedly in a continuous manner along the length of the web as it is moved past the printing drum 30.

The printing machine 28 illustrated in FIG. 5 also includes one or more additional conventional printing drums 36 for sequentially printing ink of one or more colors on both sides of the liner, including atop the liner 14 and below the low adhesion surface spots prior to printing the silicone spots thereon. Both sides of the web may be printed by the drums using conventional turning bars to turn the web to properly face the drums. In this way, a continuous printing process for the silicone spot liners 14 may be effected.

Furthermore, the same type of printing machine 28, without the silicone printing drum 30, may be used for independently printing both sides of the overlay 12 in a corresponding web 34 configured specifically therefor. Both printing processes and printing machines for the overlay 12 and the liner 14 are otherwise conventional except for the introduction of the silicone printing drum 30 and the curing device 32 cooperating therewith.

As shown in FIG. 6, an additional laminating machine 38 is used for laminating or bonding the liners 14 below corresponding ones of the overlays 12 as they are unwound from the corresponding rolls 34*b*. The laminating machine 38 may have any conventional configuration such as that used for presently forming the integrated label sheets introduced above in the background section. The adhesive 18 is supplied between the overlay 12 and the liner 14 over both the low and high adhesion surfaces 16,14*c*. The adhesive 18 is typically a hot melt adhesive which bonds together the overlay and liner after cooling thereof.

The laminated overlay and liner are carried sideways through a pair of opposing rollers 40 to a conventional cleaving drum 42 which is configured for cleaving the separation joints 22 in the overlay 12 after the liner 14 is laminated thereto.

In the exemplary embodiment of the label sheet illustrated in FIG. 1, multiple labels 20 are defined in the overlay 12 atop the liner 14. Accordingly, the cleaving drum 42 illustrated in FIG. 6 is configured for cleaving respective ones of the separation joints 22*a,b,c* in the overlay 12 around each of the several silicone spots 16 as well as for the two tear lines at the perforations. Either the same cleaving drum 42 may be used for forming both the die-cuts 22*a* and the perforations 22*b,c*, or separate cleaving apparatus may be used therefor.

The individual label sheets 10 may then be cut to size using a suitable cutter 44 and stacked in reams, or otherwise packed in rolls as desired.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A label sheet comprising:

a single sheet overlay including a label having a configuration, a label border surrounding said label at a die-cut therebetween, and a form adjoining said label border;

a liner having adjoining relatively low and high adhesion surfaces, and underlying said label and border and not said form;

said low adhesion surface of said liner defines a spot matching said label configuration, and said high adhesion surface surrounds said spot and defines a liner border;

an adhesive bonding together said overlay and liner at said high adhesion surface and allowing separation of said label at said low adhesion surface; and said die-cut surrounds said label for allowing removal thereof from said liner, and is disposed atop said spot and spaced laterally inwardly from said liner border and inwardly from a perimeter of said spot for permanently bonding said label border to said liner border to prevent exposed adhesive therebetween.

2. A sheet according to claim 1 wherein said overlay further includes a cleaved separation joint for separating said overlay therealong.

3. A sheet according to claim 2 wherein said separation joint is linear across said label.

4. A sheet according to claim 2 wherein:

said overlay includes a plurality of said labels within said label border, with each label being surrounded by a respective one of said die-cuts; and said liner includes a plurality of said spots corresponding with said labels for allowing individual removal of said labels from both said label border and liner.

5. A sheet according to claim 4 wherein said liner includes perimeter edges laterally recessed from corresponding edges of said overlay, and permanently bonded to said overlay by said adhesive.

6. A sheet according to claim 4 wherein said separation joint comprises a plurality of perforations disposed linearly across said label border through both said label border and liner, and through said high adhesion surface.

7. A sheet according to claim 6 further including another separation joint comprising a plurality of perforations disposed linearly across said form adjacent said label border.

8. A sheet according to claim 7 wherein said liner low adhesion surface comprises silicone.

9. A sheet according to claim 3 wherein said separation joint extends through both said label and liner.

10. A sheet according to claim 9 wherein said separation joint is disposed atop said high adhesion surface.

11. A sheet according to claim 10 wherein said separation joint comprises a plurality of perforations.

12. A label sheet comprising:

an overlay including a label having a configuration;

a liner having adjoining relatively low and high adhesion surfaces;

said low adhesion surface of said liner defines a spot matching said label configuration, and said high adhesion surface surrounds said spot and defines a liner border;

said liner includes printing thereatop and below said spot, and said spot is transparent for viewing said printing therebelow;

a die-cut surrounding said label for allowing removal thereof from said liner;

an adhesive bonding together said overlay and liner at said high adhesion surface and allowing separation of said label at said low adhesion surface; and said die-cut is disposed, atop said spot and spaced laterally inwardly from said liner border and inwardly from a perimeter of said spot for permanently bonding said label border to said liner border to prevent exposed adhesive therebetween.

13. A label sheet comprising:

an overlay including a plurality of labels spaced apart from each other in a remaining label border;

a liner having adjoining relatively low and high adhesion surfaces;

said low adhesion surfaces of said liner defining spots matching configuration of respective ones of said labels, and said high adhesion surface surrounds said spots and defines a liner border;

said overlay and liner including printing on both front and back sides thereof including under said spots, and said spots are transparent for viewing said printing therebelow;

a die-cut surrounding each of said labels for allowing removal thereof from said liner; and an adhesive bonding together said overlay and liner at said high adhesion surface and allowing separation of said labels at said low adhesion surfaces; and said die-cuts are disposed atop said spots and spaced laterally inwardly from said liner border and inwardly from a perimeter of said spots for permanently bonding said label border to said liner border to prevent exposed adhesive therebetween.

14. A method of making a label sheet comprising:

printing in a printing machine a low adhesion surface atop only a portion of a liner for leaving a relatively high adhesion surface;

printing in said printing machine ink atop said liner and below said low adhesion surface prior to printing said low adhesion surface thereon;

laminating said liner below an overlay using an adhesive therebetween over both said low and high adhesion surfaces; and forming a die-cut in said overlay after laminating said liner thereto to define a removable label atop said low adhesion surface, and said die-cut is disposed atop said low adhesion surface and spaced laterally from said high adhesion surface for preventing exposed adhesive therebetween.

15. A method according to claim 14 further comprising:

printing a plurality of said low adhesion surfaces atop said liner in the form of respective spots, with said high adhesion surface disposed therebetween; and forming respective ones of said die-cuts in said overlay around each of said spots.

* * * * *